United States Patent [19]

Leatherman

[11] Patent Number: 4,744,272

[45] Date of Patent: May 17, 1988

[54] FOLDABLE TOOL

[75] Inventor: Timothy S. Leatherman, Portland, Oreg.

[73] Assignee: Leatherman Tool Group, Inc., Portland, Oreg.

[21] Appl. No.: 853,349

[22] Filed: Apr. 17, 1986

[51] Int. Cl.[4] ..... B25B 7/22; B25G 1/00

[52] U.S. Cl. ..... 81/427.5; 81/177.6; 81/177.2; 7/128; 7/129; 7/167; 30/153; 30/255; 30/122

[58] Field of Search ..... 30/153, 255, 143, 142, 30/152, 154, 330, 331, 155, 47, 332, 122; 81/427.5, 177.2, 177.4, 177.6, 177.7, 415; 7/106, 118, 125–135, 167, 168

[56] References Cited

U.S. PATENT DOCUMENTS 592,766 11/1897 Effinger et al. ..... 81/415
1,486,725 3/1924 Brown ..... 30/154
2,575,652 11/1951 Bovee ..... 7/128 X
4,238,862 12/1980 Leatherman ..... 7/128

*Primary Examiner*—Debra Meislin
*Attorney, Agent, or Firm*—Chernoff, Vilhauer, McClung & Stenzel

[57] ABSTRACT

A foldable gripping tool has compound folding handle assemblies including channel shaped handles and handle extensions which may be folded into nested relationship with each other, and folded over the gripping jaws of the tool to enclose the jaws into a compact nested assembly. The handle extensions provide a broad smooth surface to be grasped and squeezed by the user's hand. The handle extensions include integral tools such as a can/bottle opener and screwdrivers. The tool also includes tool blades such as a knife blade and a screwdriver/file blade, independent of the handle extensions, which are also foldable into the channel shaped handles and handle extensions.

27 Claims, 4 Drawing Sheets

FIG. 2
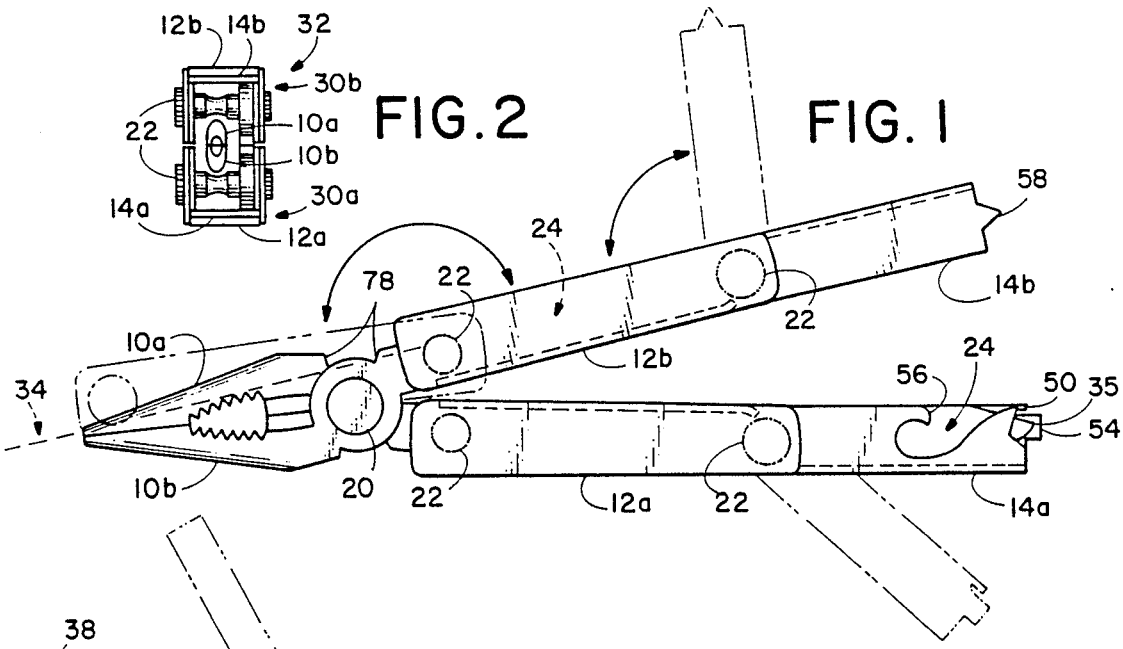
FIG. 1
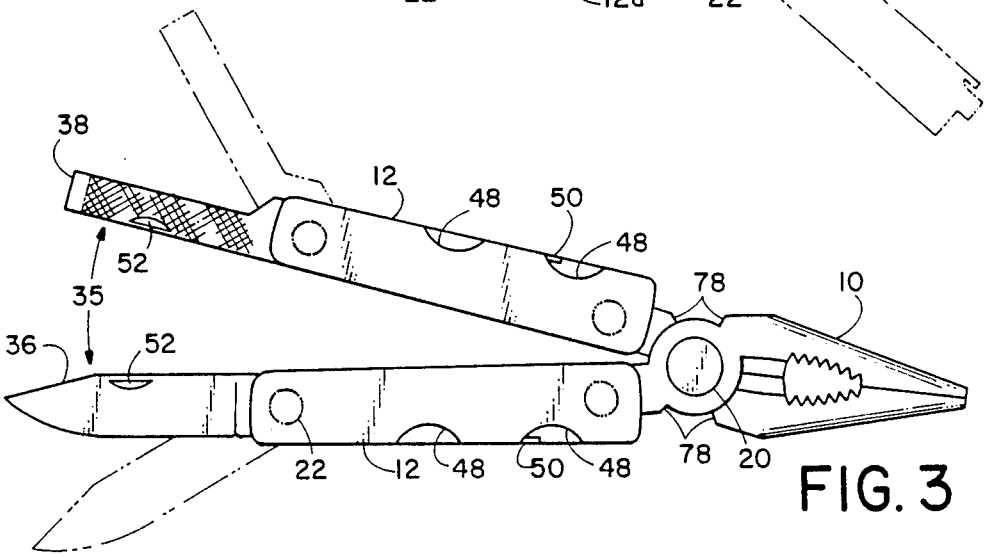
FIG. 3
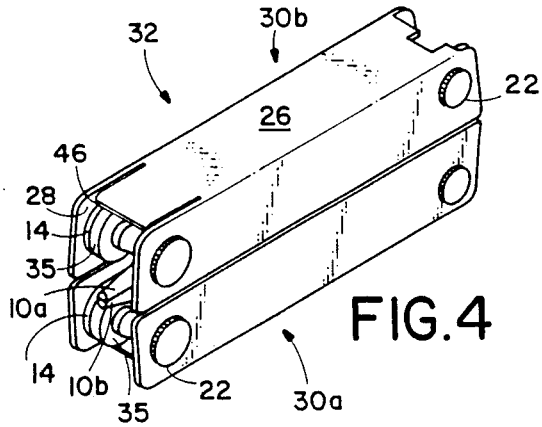
FIG. 4
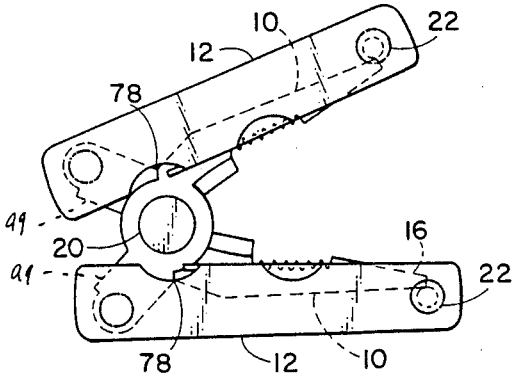
FIG. 12
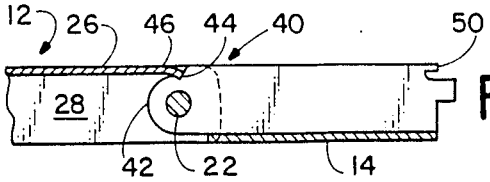
FIG. 5

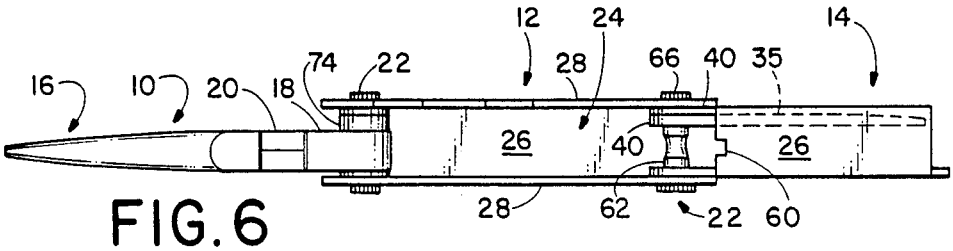
FIG. 6
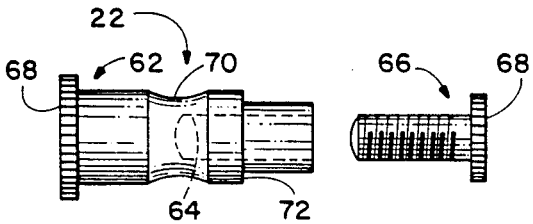
FIG. 11
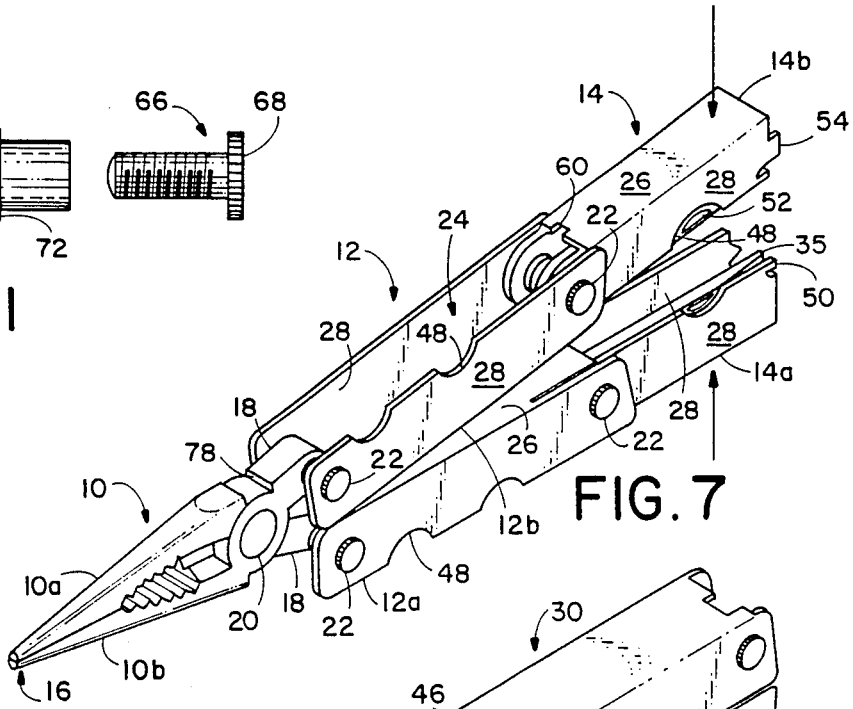
FIG. 7
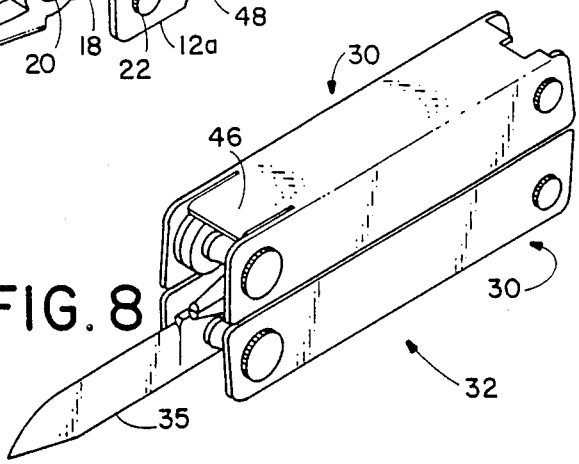
FIG. 8
FIG. 9
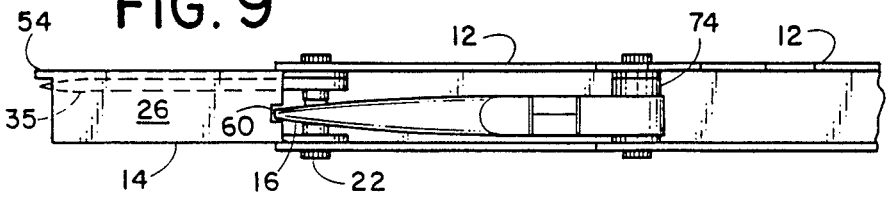
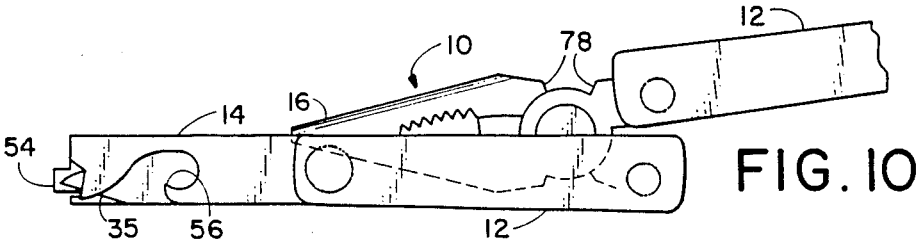
FIG. 10

FOLDABLE TOOL

BACKGROUND OF THE INVENTION

This invention relates to a foldable tool, and more particularly to such a tool having a channel shaped compound folding handle assembly including handles and handle extensions, all of which may be folded with respect to each other into a compact nested tool assembly enclosing a tool head.

The Pocket Multiple Tool disclosed in this inventor's previous patent, Leatherman U.S. Pat. No. 4,238,862, includes a pair of plier jaws which can be enclosed within folding, channel shaped handles.

SUMMARY OF THE INVENTION

The present invention provides a tool having channel shaped handle extensions which are foldable to nest with channel shaped handles and enclose the gripping jaws of the tool in a compact nested tool assembly, the handle extensions also providing broad, smooth force-receiving surfaces for permitting the user to transmit considerable gripping force to the jaws of the tool without undue discomfort.

According to the exemplary embodiments of the present invention, a pair of elongate handles are pivotally connected to a pair of plier-type cross jaws. A pair of elongate handle extensions are pivotally connected to respective handles. The handles and handle extensions are channel shaped so that the handle extensions may be pivoted into nested relationship with their respective handles and the resultant nested handle assembly pivoted with respect to the jaws so as to form a compact nested tool assembly with the jaws received and substantially enclosed within the channels of the handles and handle extensions.

Tool blades, both integral with the handle extensions and independent therefrom, may also be pivotally attached to the handles and pivoted between extended and nested positions. various embodiments of the invention include provisions for locking the tool blades and handle extensions into extended positions.

Accordingly, it is a principal object of the present invention to provide a highly functional foldable tool which may be folded into a compact nested assembly.

It is a further object of the present invention to provide such a tool having channel shaped handles and handle extensions which will nest with each other.

It is another object of the present invention to provide such a tool having comfortable, broad, smooth force-receiving surfaces for operating the gripping cross jaws of the tool.

It is a related object of the present invention to provide such a tool having compound folding handles.

It is a further object of the present invention to provide such a tool including a tool blade integral with a handle extension.

It is another object of the present invention to provide such a tool including a tool blade independent of the handle extensions.

It is a related object of the present invention to provide such a tool which includes provisions for locking a tool blade into extended position with respect to a handle.

It is a related object of the present invention to provide such a tool which includes provisions for locking a handle extension into extended position with respect to a handle.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a side elevation view of an exemplary embodiment of the tool of the present invention showing how the components are foldable with respect to each other.

FIG. 2 is an end elevation view of the tool of FIG. 1 folded into a compact nested tool assembly.

FIG. 3 is an opposite side elevation view of the tool of FIG. 1 showing how the independent tool blades are foldable with respect to the handles.

FIG. 4 is an isometric view of the tool of FIG. 1 folded into a compact nested tool assembly.

FIG. 5 is a fragmentary sectional elevation view of the tool of FIG. 1 showing a handle and handle extension.

FIG. 6 is a plan view of the tool of FIG. 1 in fully extended position.

FIG. 7 is an isometric view of the tool of FIG. 1 in fully extended position.

FIG. 8 is an isometric view of the tool of FIG. 1 with a tool blade operatively extending from the compact nested tool assembly. FIG. 1 with a tool blade compact nested tool assembly.

FIG. 9 is a plan view of the tool of FIG. 1 showing how the jaws may be used to lock a handle extension into extended position.

FIG. 10 is a side elevation view of the tool shown in FIG. 9.

FIG. 11 is a side view of a dissassembled pin assembly.

FIG. 12 is a side elevation view of the tool of FIG. 1 showing how the open jaws are received within the nested handle assemblies.

DETAILED DESCRIPTION OF THE INVENTION

Figure 13:
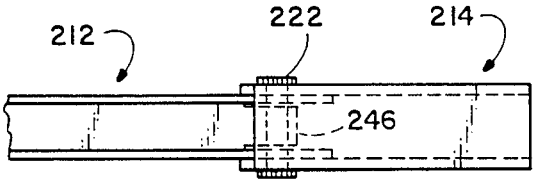
FIG. 13 is a fragmentary plan view of a handle and handle extension of an alternative embodiment of the tool of the present invention.

FIGS. 1–12 illustrate an exemplary embodiment of the foldable tool of the present invention having a pair of gripping cross jaws and compound folding handles. Referring particularly to FIG. 7, the tool shown in FIGS. 1–12 includes a pair of elongate gripping jaws 10, a pair of elongate handles 12, and a pair of elongate handle extensions 14. More specifically, the tool includes first and second curved elongate cross jaws 10*a* and 10*b*, respectively, each of the jaws including a nose 16 having a gripping portion, and a tang 18. The cross jaws are pivotally connected to each other by a bearing 20 intermediate the nose and tang. First and second elongate handles 12*a* and 12*b*, respectively, are attached to the respective first and second jaws by pins 22 which pivotally connect the inner ends of the handles to the tangs of the respective jaws. The handles are pivotable about the pins between extended and retracted positions with respect to the jaws. In a similar fashion, first and second elongate handle extensions, 14*a* and 14*b* respectively, are pivotally attached to the outer ends of the first and second handles by pins 22 and pivotable between extended and retracted positions with respect to their associated handles.

As may be seen in FIGS. 6 and 7, the handles and handle extensions are formed in the shape of elongate open channels 24 defined by a web 26 and two upstanding sidewalls 28. FIGS. 1 and 4 show that each of the handle extensions may be pivoted into nested handle assemblies 30—first and second nested handle assemblies 30*a* and 30*b*, respectively—with their associated handles. Each of the nested handle assemblies may be pivoted to enclose the cross jaws in a compact nested tool assembly 32, shown in FIG. 4, with the first jaw 10*a* received in an open channel of the second nested handle assembly 30*b*, and the second jaw 10*b* received within an open channel of the first nested handle assembly 30*a*.

Note that the elongate handle extensions are substantially coaxial with their respective elongate handles when configured in nested handle assemblies therewith and that the nested handle assemblies are substantially coaxial with an axis 34, shown in FIG. 1, of the nose of the opposite cross jaw when the tool is folded into the compact nested tool assembly 32 shown in FIG. 4. Note also that the nested tool assembly is compact, substantially defined by the two handles arranged closely adjacent each other with their respective axes parallel.

A stop 99, shown in FIG. 12, cooperates between the tangs of the cross jaws and their respective handles to prevent further pivoting of the handles with respect to the jaws once they have reached the extended position shown in FIGS. 1, 3 and 7, with the outer ends of the handles spread apart. In a similar fashion, a stop, shown in FIG. 5, cooperates between the handle extensions and their respective handles to prevent further pivoting of the handle extensions with respect to the handles once they have reached the extended position shown in FIGS. 1 and 7.

When the tool is fully unfolded into extended position as shown in FIG. 7, the stops described above cooperate with their associated jaws, handles and handle extensions to allow the gripping portions of the jaws to be forced together when the spread apart handle extensions are urged toward each other as represented by the large dark arrows in FIG. 7. Note that the respective webs 26 of the handle extensions provide broad, smooth force-receiving surfaces to permit the user of this tool to comfortably squeeze the handle extensions together to apply considerable force to the gripping jaws when using this tool. It will be recalled that the prior art folding pliers did not have such broad, smooth, force-receiving surfaces.

Referring to FIG. 5, the base 40 of the handle extension includes a curved cam surface 42 and a notched seat 44. The web 26 proximate the outer end of the handle incorporates an integral spring 46 which is bent downwardly into the open channel, extending between the upstanding side walls 28 of the handle. When the handle extension is pivoted between nested and extended positions, the cam surface causes the spring to deflect and provide a frictional resistance to prevent the handle extension from freely pivoting, or flopping, about the pin. As the handle extension is pivoted into extended position, the spring drops into the notched seat formed in the base of the handle extension and resiliently locks the handle extension into extended position, the edge of the spring abutting against a wall of the notched seat and acting as a stop to prevent further pivoting of the handle extension. It should be noted that when the handle extension is in the extended position shown in FIG. 5 with the spring seated in the notched seat, the spring exerts a force on the edge of the notched seat which resiliently retains the handle extension in the extended position. This force is sufficient to permit the jaws of the tool to be opened by urging the handle extensions apart.

Referring to FIG. 3, the exemplary tool of the present invention includes elongate tool blades 35, in this case a knife blade 36 and a combination screwdriver/file 38, each tool blade pivotally connected to the outer end of one of the handles by the same pin 22 which pivotally attaches the respective handle extension. Of course, it should be understood that the choice of the tool blades is arbitary and that other types of blades, such as an awl, could be substituted for those shown herein. Like the handle extensions, the tool blades pivot between extended and retracted, or nested positions with respect to their associated handles. Note that like the handle extensions, the elongate tool blades are substantially coaxial with their respective elongate handles and handle extensions in both extended and nested positions.

Each of the tool blades also includes a base 40, cam surface 42, and notched seat 44 substantially identical to those features described above and shown in FIG. 5 with respect to the handle extension. The spring 46 cooperates with the notched seat of the handle extension to stop and resiliently lock the tool blade in extended position. As explained in the following paragraphs the tool blades may be pivoted into extended position either simultaneously with, or independently of, the handle extensions.

As shown in FIG. 1, since the tool blades are received in the open channels 24 of the handle extensions, the tool blades may be pivoted into extended position with respect to the handles by manipulating the handle extensions. Referring to FIG. 3, each of the handles include a curved recess 48 in one of the sidewalls thereof. The handle extensions each include a finger 50 which is aligned with the curved recess of its respective handle when the handle extensions are nested in the open channels of their respective handles, with the finger of the handle extension adjacent to the curved recess of the handle. The curved recess and finger provide a convenient way to engage the handle extension with a fingernail and pivot the handle extension and associated tool blade out of the open channel of the handle.

Once the handle extension and associated tool blade are in extended position with respect to their handle, the resistive force of the spring upon the substantially identical curved cam surface of the tool blade permits the tool blade to be retained in extended position while the handle extension is pivoted back into nested relationship with its respective handle. Alternatively, a tool blade may be pivoted into extended position independently of its handle extension by engaging the nail nick 52 on the tool blade which is accessed through corresponding curved recesses 48 on the handles, as shown in FIG. 3, and on the handle extensions as shown in FIG. 7.

The tool blade may be returned to nested relationship with its respective handle either by pivoting it about the pin 22 as shown in FIG. 3, or by repositioning the handle extension into extended position, and then pivoting both handle extension and associated tool blade into the open channel of the handle. The advantage of the latter method is that during manipulation the tool blade is shielded within the open channel of the handle extension as shown in FIGS. 1 and 5, preventing injury to the user.

FIG. 8 illustrates the preferred configuration for using the tool blades of the tool, with the remainder of the tool folded into the compact nested tool assembly 32, which provides a convenient and comfortable handle for grasping the tool and manipulating the tool blade. Using the tool as shown in FIG. 8 also prevents the tool blade from pivoting back toward the retracted or nested position and cutting the user's hand in a manner common to folding pocket knives. As shown in FIG. 8, the upper nested handle assembly 30 prevents the tool blade from pivoting into contact with the user's hand, which would be gripping the entire compact nested tool assembly.

From the drawings it will be apparent that the handle extensions also include integral tool blade components such as a screwdriver tip 54, a can/bottle opener 56, and a partial Phillips head tool 58. As pointed out above, choice of the particular types of tools is arbitrary. When using the tool blade components integral to the handle extensions it is possible to positively lock the handle extensions into extended position. Referring to FIGS. 9 and 10, a portion of the web 26 of which is proximate the pin includes a pocket 60 formed therein. When the handle extension is in extended position, the jaws may be folded into retracted position with respect to the handle which is connected to the extended handle extension. The nose 16 of the jaws are received in the pocket, thereby preventing the handle extension from pivoting back toward its respective handle. For clarity, FIGS. 9 and 10 show the opposite handle in extended position with respect to the jaws. However, it should be recognized that the opposite handle could be pivoted into the compact nested tool assembly shown in FIG. 8 with the handle extension including the tool blade component extending from the compact nested tool assembly.

As previously explained, the spring 46 integral with the web 26 of the handle is bent downwardly into the open channel extending between the sidewalls. There are two important reasons for the bent spring. First, as referred to above, the bent spring provides a line of force on the notched seat of the cam when the handle extension or tool blade is in extended position, providing more positive resilient locking force than could be achieved with a straight spring such as used with the prior art folding tool. Secondly, because the handle extensions must nest flush within the open channels of the handles, it follows that the sidewalls of the handle extensions are shorter than the sidewalls of the handles. As a consequence, when the handle extensions are pivoted into extended position as shown in FIG. 1, the webs of the handle extensions would not be flush with the tops of the sidewalls of their associated handles. This discrepancy could cause discomfort to the user when applying squeezing force to the handle extensions proximate the outer ends of the handles. However, the downwardly bent spring allows the handle extension to be pivoted to an extended position substantially coaxial with its associated handle, with the web of the handle extension flush with the top of the sidewalls of the handle for a comfortable grip.

FIG. 11 shows a pin assembly 22 of the type used to pivotally connect the handle extensions and tool blades to the outer ends of their respective handles. The pin assembly includes a cylindrical post 62 having a threaded recess 64 for receiving a cylindrical threaded screw 66. Both post and screw have knurled heads 68 with approximately 35 teeth per inch. When the tool is assembled, the screw is engaged in the threaded recess and may be tightened to specifications by a special tool which engages the knurled heads of the post and screw. It will be appreciated that proper tightening of the screw in the threaded recess is important to prevent the pivotable components of the tool from being either too tightly or too loosely connected to each other.

Note that the post 62 has a groove 70 formed circumferentially therein. As may be seen in FIGS. 2, 9 and 10, the groove permits the tool to employ long, needle-nose type jaws, yet be capable of folding into a compact nested tool assembly by receiving the nose of the jaws in the groove.

Note also that the pin includes a shoulder 72 where the radius of the post abruptly decreases. When the tool is assembled, the shoulder of the pin is arranged adjacent the base 40 of a tool blade 35 and serves to stablize the tool blade. Referring to FIG. 6 it will be understood that as the screw is tightened within the threaded recess of the post, the base of the tool blade is securely pinched between the adjacent base of the handle extension and the shoulder of the pin, which cooperate to provide good lateral support for the tool blade. Of course, it will be understood that alternative embodiments which employ a washer or sleeve to pinch the base of the tool blade against the handle extension are within the scope of the present invention.

The pins 22 which pivotally connect the inner ends of the handles to the jaws are similar to the pins described above in that they include a post with a threaded recess and a screw, both post and screw having knurled heads. However, the jaw pins have no need for the circumferential groove described above. Referring again to FIG. 6, it will be seen that it is advantageous to provide some type of abutment, either a washer 74 as shown in FIG. 6, or a shoulder on the pin as described above, in order to laterally stablize the jaws.

FIG. 12 shows the exemplary embodiment in an open nested assembly configuration with the jaws of the tool opened to their fullest extent. As may be seen more readily in FIGS. 1, 3, 7 and 10, each of the cross jaws include a pair of shoulder stops 78 on the back of the jaw and on the tang. Each shoulder stop cooperates with a shoulder stop of the cross jaw in a manner shown in FIG. 12 to limit the pivoting of the cross jaws with respect to each other, thereby limiting the opening of the jaws. It should be noted that when the jaws are opened to their fullest extent with the jaws nested within the handles, the tip of the needle-type nose 16 of the jaws rests in the groove 70 of the pin 22. It will be seen that as the jaws are pivoted about the bearing 20 to close the jaws, the jaws and bearing will move toward the outer ends of the handles. If the nose did not overlap the pin, the needle-type nose of the jaws could become lodged beneath the pin when the tool is squeezed together from the open nested assembly configuration shown in FIG. 12 to the closed, compact nested tool assembly shown in FIG. 4.

FIGS. 13–27 show alternative features or embodiments not described above with respect to the exemplary embodiment. Most of FIGS. 13–27 relate to embodiments of a foldable tool with compound folding handles having an outside handle extension configuration wherein the handles are nested within the open channels of the handle extensions.

Figure 14:
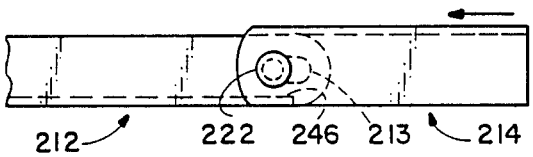
FIG. 14 is a side elevation view of the tool shown in FIG. 13.
Figure 15:
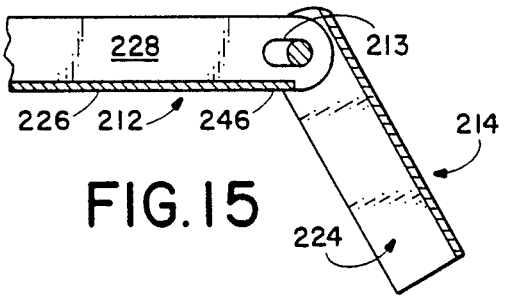
FIG. 15 is a fragmentary sectional elevation view of the embodiment shown in FIG. 13 showing how the handle extension pivots with respect to the handle.

Referring particularly to FIGS. 13–15, handle 212 includes a slot 213 in the sidewalls 228 thereof. A pin 222 pivotally connects the handle extension 214 to the outer end of the handle. Like the exemplary embodiment described above, the handle extension is pivotable between extended and retracted, nested positions with respect to the handle, except in this embodiment the handle extension nests outside of the handle, with the handle received within the open channel 224 of the handle extension.

The handle extension is locked into extended position by sliding the handle extension inwardly toward the inner end of the handle as shown in FIGS. 13 and 14, thereby moving the pin to the inner end of the slot. In FIG. 14, with the pin at the outer end of the slot, the handle extension may be pivoted between extended and nested positions. However, when the handle extension and pin are moved inwardly from the outer end of the handle, thereby moving the rotational axis of the pin inwardly, the handle extension is too far overlapping the outer end of the handle to pivot about the pin.

With reference to FIG. 7, it will be readily understood that when the handle extensions are locked into extended position as shown in FIGS. 13 and 14, the handle extensions may be manually squeezed together to urge the jaws of the tool together or urged apart to spread the jaws apart. It should also be pointed out that the embodiment shown in FIGS. 13–15 will also form a compact nested assembly similar to that shown in FIG. 4, except that the handle extensions will be nested outside of the handles.

Figure 16:
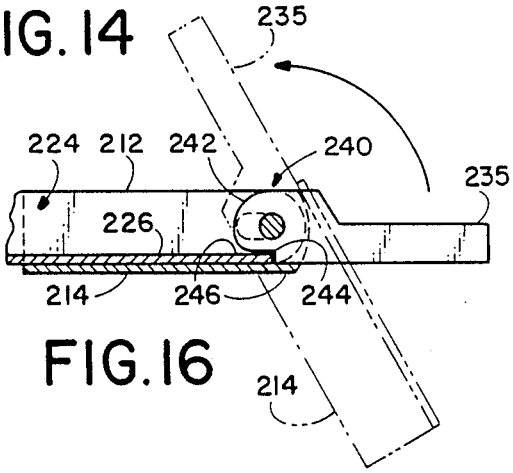
FIG. 16 is a fragmentary sectional elevation view of the embodiment shown in FIG. 13 including an independent tool blade interacting with the handle extension.

The embodiment shown in FIGS. 13–16, like the previously described embodiment, includes an integral spring 246 in the web 226 of the handle proximate the outer end of the handle. FIG. 16 shows this embodiment having a tool blade 235 pivotable about the pin 222 between an extended position and a retracted, nested position, wherein the tool blade is received within the open channel 224 of the handle. Note that unlike the spring 46 of the exemplary embodiment, the spring 246 shown in FIGS. 13–16 is not bent downwardly between the sidewalls of the handle.

As explained above with respect to the exemplary embodiment, the tool blade includes a base 240 with a cam surface 242 and a notched seat 244 similar to that described with respect to the exemplary embodiment. When the tool blade is pivoted between extended and nested positions, the cam surface of the base of the tool blade causes the spring 246 to deflect. When the tool blade is in extended position, the spring abuts the wall of the notched seat 244 in the manner shown in FIG. 16 and prevents further rotation of the tool blade beyond the extended position.

The tool blade is pivoted and locked in the extended position shown in FIG. 16 by simultaneously pivoting the handle extension into nested relationship with the handle. With the handle extension in nested position, the web of the handle extension lies closely adjacent the web of the handle and prevents the spring 246 from deflecting, thereby preventing the tool blade from pivoting.

It should be noted that the embodiments shown in FIGS. 17–20 and 25–27, all having an outside handle extension configuration, include the locking feature for the tool blade described above, wherein the handle extension, in nested position, prevents the spring from deflecting, thereby locking the tool blade in extended position.

Applicant believes that this feature of the present invention could be applied to other folding tools by providing a similar spring and an operable locking mechanism to selectively prevent the spring from deflecting, and accordingly does not intend to limit application of this feature to a foldable gripping tool having handle extensions.

Figure 17:
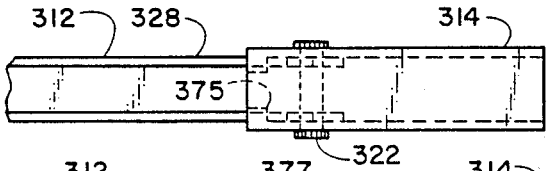
FIGS. 17–20 are views of a further embodiment of the present invention which correspond to the views of FIGS. 13–16, respectively.
Figure 18:
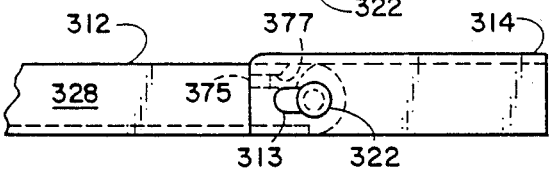
Figure 19:
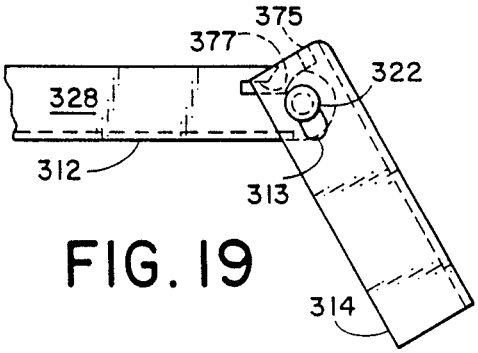

Turning now to FIGS. 17–20, the handle extension 314 is again pivotally connected to the outer end of the handle 312 by a pin 322, and is pivotable between an extended position shown in FIGS. 17 and 18 and a retracted, nested position. However, in this embodiment the slot 313 is formed in the handle extension, rather than the handle. The inner end of the handle extension, inwardly of the slot, includes an opposed pair of short arms 375 extending into the open channel which defines the handle extension. The sidewalls 328 of the handle include a pair of opposed niches 377 adapted and arranged to receive the arms of the handle extension when the handle extension is slid inwardly with respect to the handle and pin to the position shown in FIGS. 17 and 18, with the pin at the outer end of the slot 313. In this manner the handle extensions are locked in extended position with respect to the handles so that the handle extensions may be grasped and squeezed together in order to urge the jaws of the tool together or spread apart to urge the jaws apart.

Figure 20:
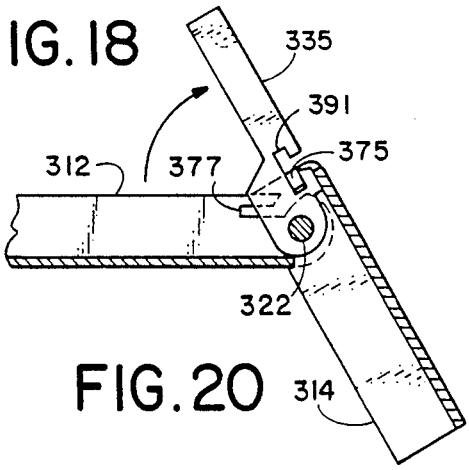

As shown in FIG. 20, the tool blade 335 of this embodiment includes a T slot 391 formed near the base of the tool. The cross member of the T slot permits one of the arms 375 of the handle extension to slide back and forth in the T slot as the handle extension is slid back and forth with respect to the handle. When the handle extension is in the outermost position with respect to the handle, the arm 375 of the handle extension engages a portion of the T slot in the tool blade, as shown in FIG. 20, and the tool blade may be pivoted out of nested position and into extended position by pivoting the handle extension toward its nested position thus allowing the tool blade to be folded open without using a fingernail nick.

Figure 25:
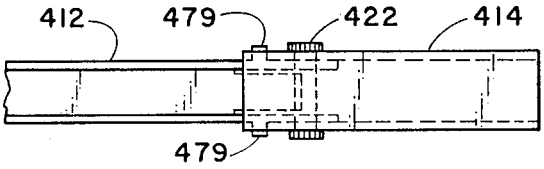
FIGS. 25–27 are views of a further embodiment of the present invention which correspond to the views of FIGS. 13–15, respectively.
Figure 26:
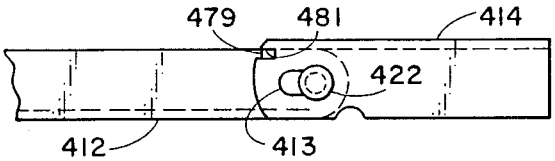
Figure 27:
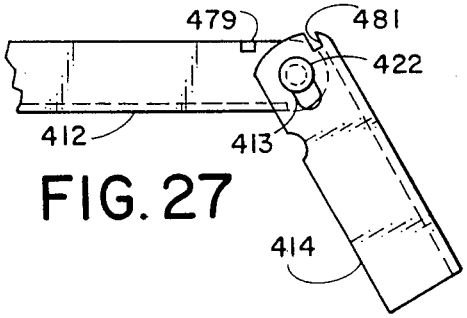

FIGS. 25–27 show another embodiment having an outside handle extension configuration similar to that shown in FIGS. 17–20, except that the handle sidewalls include a pair of projecting ears 479 which are received in sockets 481 in the handle extension sidewalls when the handle extension is slid inwardly with respect to the pin 422 and handle 412. The engagement of the ears 479 in their respective sockets 481 locks the handle extensions in extended position and permits the handle extensions to be grasped and squeezed together to urge the jaws of the tool together or urged apart to spread the jaws apart.

Figure 21:
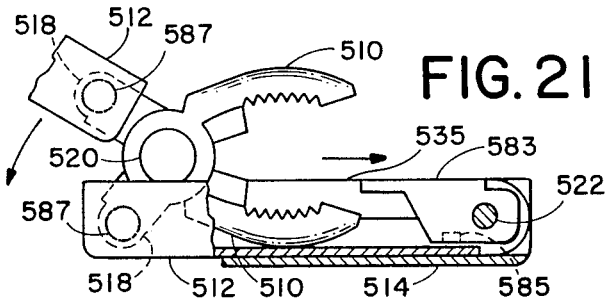
FIG. 21 is partial sectional view of another embodiment of the tool of the present invention having a tool blade lifter.
Figure 22:
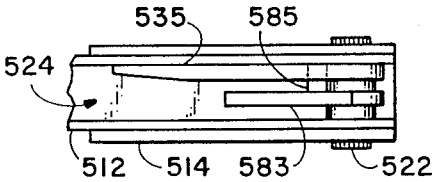
FIG. 22 is a partial plan view of the tool shown in FIG. 21.
Figure 23:
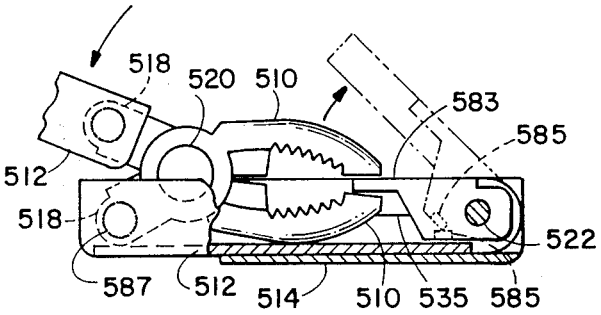
FIG. 23 is a partial sectional view of the tool shown in FIG. 21 showing operation of the tool blade lifter.

FIGS. 21–23 show another embodiment of the present invention wherein the gripping jaws 510 of the tool may be used to pivot the tool blade 535 out of nested position within the handle 512. Referring to FIG. 22, a lifter 583 is pivotally connected to the outer end of the handle by the pin 522, and pivotable between extended and retracted, nested positions with respect to the handle. The lifter includes a tab 585 which extends beneath the base of the tool blade.

It will be recalled that each of the jaws is pivotally connected to a handle by pins, more specifically jaw pins 587 cooperating between the tangs 518 of the jaws and the inner ends of the handles 512. It should also be recalled that the jaws are pivotally connected to each other by a bearing 520 intermediate the nose of the jaws and the tangs. Referring to FIGS. 21 and 23, it will be understood that when the upper tang, which is associated with the lower jaw, is brought toward the lower tang, which is associated with the upper jaw, the lower jaw will pivot about the bearing and the upper jaw will pivot about the lower pin causing the bearing and the jaws to move toward the outer end of the handle. This movement of the jaws positions the nose of the lower jaw beneath the lifter. Further downward pressure on the upper tang causes both jaws to pivot about the lower pin 587 lifting the nose of the jaws, the lifter, and the tool blade out of the open channel of the handle. Once the tool blade is pivoted out of the channel of the handle, as shown in FIG. 23, the tool blade may be pivoted into extended position and the lifter returned to nested position.

Figure 24:
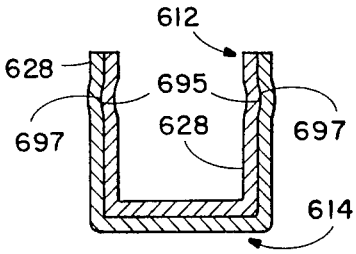
FIG. 24 is an end sectional view showing a handle nested in the open channel of a handle extension.

All of the embodiments employing the outside handle extension configuration need some device to prevent the handle extensions from freely pivoting, or flopping, between nested and extended positions. As shown in FIG. 24, one method of retaining the handle extension in nested position with respect to its handle is to form a dimple 695 on the sidewalls 628 of one member and corresponding projections 697 on the sidewalls 628 of the other member so that the projection will seat in the dimple and retain the handle extension in nested position with respect to the handle. Another method, not shown, is to pinch the sidewalls of the handle extension inwardly toward the sidewalls of the handle so as to frictionally engage the sidewalls of the handle.

Applicant does not intend the present invention to be limited to the specific embodiments described above and shown in the accompanying drawings. For example, although only one tool blade is shown in association with each handle, it should be clear that embodiments which employ more than one tool blade in association with a handle are within the scope of the invention. Similarly, although the exemplary embodiment shown in FIGS. 1–12 positions a handle extension within the open channel of a handle and a tool blade within the open channel of the handle extension, it is contemplated that the handle extension and tool blade could be arranged adjacent to each other in the open channel of the handle.

Other alternative embodiments considered to be within the contemplation of the invention include an extensible channel shaped handle extension which slides, rather than pivots, with respect to its associated handle, yet in retracted position is capable of forming a nested handle assembly with its handle and enclosing the gripping jaws or other tool head.

Indeed, this invention should not be limited to an embodiment including gripping cross jaws, but could be applied to any foldable tool having a tool head and compound folding handle assemblies which may be folded into a compact nested assembly with the tool head enclosed by the nested handle assemblies.

It should also be noted that the method for locking the handle extension into extended position shown in FIGS. 9 and 10, may be accomplished in other ways, not specifically shown or described, but within the concept of the present invention. For example, a pawl could be used rather than the jaws to engage the pocket 60 and lock a handle extension, or other extensible tool, into extended position.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A foldable tool comprising:

(a) a pair of elongate gripping jaws, each of said jaws including a gripping portion proximate one end thereof and a tang proximate the other end, said jaws pivotably connected to each other intermediate said respective ends;

(b) a pair of elongate handles, each handle having an inner end pivotally connected to a respective one of said tangs and an outer end opposite said inner end;

(c) a pair of elongate handle extensions, each of said handle extensions pivotably connected proximate one end thereof to a respective one of said outer ends of said handles;

(d) said handles and said handle extensions including respective open channel means for permitting said handle extensions to be selectively pivoted from a nested handle assembly, wherein said handles or alternatively said handle extensions are respectively received within said open channel means of the other, to extended positions with respect to each other, wherein neither of said handles or said handle extensions are received within the open channel means of the other, said respective open channel means also serving as means for permitting said nested handle assemblies to be selectively pivoted with respect to said respective jaws into a nested tool assembly with said jaws received within said open channel means of, alternatively, said handles or said handle extensions; and (e) said handle extensions arranged with respect to said respective handles so that said respective open channel means of said handles and said handle extensions face in opposite directions when said handle extensions are in extended relationship with said respective handles.

2. The tool of claim 1 wherein said jaws are substantially enclosed within said open channel means when said tool has been selectively pivoted into said nested tool assembly.

3. The tool of claim 1 wherein said nested tool assembly is substantially defined by said handles arranged adjacent each other with their respective axes parallel.

4. The tool of claim 1 wherein said handle extensions are received in said open channel means of said respective handles when pivoted into said nested handle assemblies therewith.

5. The tool of claim 1 wherein said handles are received in said open channel means of said respective handle extensions when pivoted into said nested handle assemblies therewith.

6. The tool of claim 1 wherein one of said handle extensions includes integral tool blade means for working or manipulating material.

7. The tool of claim 1 including operable locking means cooperating between one of said handles and said respective handle extension for selectively locking said handle extension into extended position with respect to said handle.

8. The tool of claim 7 wherein said locking means include a pin pivotally interconnecting said handle extension to said respective handle, said handle including slot means for permitting said pin and said handle extension to slide axially with respect to said handle.

9. The tool of claim 7 wherein said locking means include a pin pivotally interconnecting said handle extension to said respective handle, said handle extension including slot means for permitting said handle extension to slide axially with respect to said handle and pin.

10. The tool of claim 9, further including operable engagement means cooperating between said handle and said respective handle extension for selectively preventing pivoting of said handle extension with respect to said handle.

11. The tool of claim 1 including means cooperating between said gripping portion of one of said jaws and one of said handle extensions for locking said handle extension into an extended position with respect to said respective handle.

12. The tool of claim 1 including pin means for permitting one of said handle extensions to be pivoted between extended and nested positions with respect to said respective handle, and further including a tool blade pivotable about said pin means between extended and nested positions with respect to said handle.

13. The tool of claim 12 wherein said tool blade and handle extension are both received within said open channel means of said respective handle when in said nested positions therewith.

14. The tool of claim 12 wherein said tool blade is received within said open channel means of said respective handle extension when in said nested position with said respective handle.

15. The tool of claim 12, further including means cooperating between said tool blade and said handle extension for pivoting said tool blade from said nested position to said extended position with respect to said handle by manipulating said handle extension.

16. The tool of claim 12, further including means cooperating between said tool blade and said handle extension for pivoting said tool blade from said extended position to said nested position by manipulating said handle extension.

17. The tool of claim 12, including means cooperating with one of said jaws for pivoting said tool blade out of said nested position with respect to said handle.

18. The tool of claim 12, including operable locking means for selectively locking said tool blade in said extended position.

19. The tool of claim 5, including a tool blade pivotally attached to said outer end of one of said handles and pivotable between extended and nested positions with respect to said handle, said handle and said respective handle extension cooperating as locking means for locking said tool blade in said extended position when said handle extension is in said nested handle assembly with said respective handle.

20. The tool of claim 19 wherein open channel means of said handle includes a web and two upstanding sidewalls, said locking means including spring means integral with said web for deflecting to permit said tool blade to be pivoted between said extended and nested positions, said handle extension preventing said spring means from deflecting when said handle extension is in said nested handle assembly with said handle.

21. The tool of claim 20 wherein said tool blade includes a base proximate said handle, said base including a cam surface and seat means for receiving said spring means when said tool blade is in said extended position.

22. The tool of claim 12 wherein said pin means includes stabilizing means for substantially preventing movement, other than pivoting movement, of said tool blade with respect to said handle.

23. The tool of claim 22 wherein said stabilizing means forces said tool blade laterally against said handle extension.

24. A foldable tool comprising:

(a) a pair of elongate gripping jaws, each of said jaws including a gripping portion proximate one end thereof and a tang proximate the other end, said jaws pivotably connected to each other intermediate said respective ends;

(b) a pair of elongate handles, each handle having an inner end pivotally connected to a respective one of said tangs and an outer end opposite said inner end;

(c) a pair of elongate handle extensions, each of said handle extensions pivotably connected proximate one end thereof to a respective one of said outer ends of said handles;

(d) said handles and said handle extensions including respective open channel means for permitting said handle extensions to be selectively pivoted from a nested handle assembly, wherein said handles or alternatively said handle extensions are respectively received within said open channel means of the other, to extended positions with respect to each other, wherein neither of said handles or said handle extensions are received within the open channel means of the other, said respective open channel means also serving as means for permitting said nested handle assemblies to be selectively pivoted with respect to said respective jaws into a nested tool assembly with said jaws received within said open channel means of, alternatively, said handles or said handle extensions; and (e) a tool blade pivotally connected to said outer end of one of said handles and pivotable between extended and nested positions with respect to said handle, said respective handle extension including guard means for shielding said tool blade from the user's hand when said handle extension and said tool blade are both in said extended positions.

25. A foldable tool comprising:

(a) a pair of elongate gripping jaws, each of said jaws including a gripping portion proximate one end thereof and a tang proximate the other end, said jas pivotably connected to each other intermediate said respective ends;

(b) a pair of elongate handles, each handle having an inner end pivotally connected to a respective one of said tangs and an outer end opposite said inner end;

(c) a pair of elongate handle extensions, each of said handle extensions pivotably connected proximate one end thereof to a respective one of said outer ends of said handles;

(d) said handles and said handle extensions including respective open channel means for permitting said handle extensions to be selectively pivoted from a nested handle assembly, wherein said handles or alternatively said handle extensions are respectively received within said open channel means of the other, to extended positions with respect to each other, wherein neither of said handles or said handle extensions are received within the open channel means of the other, said respective open channel means also serving as means for permitting said nested handle assemblies to be selectively pivoted with respect to said respective jaws into a nested tool assembly with said jaws received within said open channel means of, alternatively, said handles or said handle extensions; and (e) said open channel means respectively defined by a web and two upstanding sidewalls attached thereto, said webs of said handle extensions facing away from each other when said handle extensions are in extended relationship with said respective handles.

26. A foldable tool comprising:

(a) a tool head;

(b) a pair of elongate handles, each handle having an inner end pivotally connected to said tool head and an outer end opposite said inner end;

(c) a pair of elongate handle extensions, each of said handle extensions pivotably connected proximate one end thereof to a respective one of said outer ends of said handles;

(d) said handles and said handle extensions including respective open channel means for permitting said handle extensions to be selectively pivoted from a nested handle assembly, wherein said handles or alternatively said handle extensions are respectively received within said open channel means of the other, to extended positions with respect to each other, wherein neither of said handles or said handle extensions are received within the open channel means of the other, said respective open channel means also serving as means for permitting said nested handle assemblies to be selectively pivoted with respect to said tool head into a nested tool assembly with said tool head received within said open channel means of, alternatively, said handles or said handle extensions; and (e) said handle extensions arranged with respect to said respective handles so that said respective open channel means of said handles and said handle extensions face in opposite directions when said handle extensions are in extended relationship with said respective handles.

27. The tool of claim 26 wherein said tool head includes a pair of gripping cross jaws.

* * * * *

UNITED STATES PATENT AND TRADEMARK OFFICE

CERTIFICATE OF CORRECTION

PATENT NO. : 4,744,272

DATED : May 17, 1988

INVENTOR(S) : Timothy S. Leatherman

It is certified that error appears in the above-identified patent and that said Letters Patent is hereby corrected as shown below:

| | |
|---|---|
| Col. 1, line 41 | Change "various" to --Various-- |
| Col. 2, line 30 | Delete --Fig. 1 with a tool blade compact nested tool assembly.-- |
| Col. 13, line 3 | Change "jas" to --jaws-- |

Signed and Sealed this

Fourteenth Day of November, 1989

*Attest:*

JEFFREY M. SAMUELS

*Attesting Officer* *Acting Commissioner of Patents and Trademarks*